US008044914B2

(12) United States Patent
Lee et al.

(10) Patent No.: US 8,044,914 B2
(45) Date of Patent: Oct. 25, 2011

(54) METHOD OF COMPENSATING FOR KICK-BACK VOLTAGE AND LIQUID CRYSTAL DISPLAY USING THE SAME

(75) Inventors: Jae-chul Lee, Seoul (KR); Jong-seon Kim, Seongnam-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 855 days.

(21) Appl. No.: 12/047,582

(22) Filed: Mar. 13, 2008

(65) Prior Publication Data

US 2008/0224983 A1 Sep. 18, 2008

(30) Foreign Application Priority Data

Mar. 13, 2007 (KR) ..... 10-2007-0024674

(51) Int. Cl.
*G09G 3/36* (2006.01)

(52) U.S. Cl. ..... 345/98; 345/87; 345/89; 345/92; 345/94; 345/100

(58) Field of Classification Search ..... 345/89, 345/98, 100

See application file for complete search history.

(56) References Cited

U.S. PATENT DOCUMENTS

| | | | | |
|---|---|---|---|---|
| 7,417,612 | B2 * | 8/2008 | Lee et al. | 345/89 |
| 2006/0066553 | A1 * | 3/2006 | Deane | 345/98 |
| 2007/0052658 | A1 * | 3/2007 | Kim | 345/100 |

FOREIGN PATENT DOCUMENTS

| | | |
|---|---|---|
| JP | 2001-128090 | 5/2001 |
| JP | 2004-287113 | 10/2004 |
| KR | 2002-91689 | 12/2002 |
| KR | 2002-95979 | 12/2002 |

* cited by examiner

*Primary Examiner* — Sumati Lefkowitz
*Assistant Examiner* — Andrew Yeretsky
(74) *Attorney, Agent, or Firm* — Stanzione & Kim, LLP

(57) ABSTRACT

A method and apparatus of compensating for a kick-back voltage to reduce the generation of flicker in a liquid crystal display (LCD). The method of compensating for a kick-back voltage includes correcting input pixel data using a kick-back correction function that meets a condition on which a response characteristic of a voltage detected from a pixel electrode of a liquid crystal cell for a positive input pixel signal and a response characteristic of a voltage detected from the pixel electrode of the liquid crystal cell for a negative input pixel signal become symmetrical without causing a saturation state on a basis of a kick-back voltage measured from an LCD panel to generate corrected pixel data, and driving the LCD panel using the corrected pixel data.

21 Claims, 7 Drawing Sheets

METHOD OF COMPENSATING FOR KICK-BACK VOLTAGE AND LIQUID CRYSTAL DISPLAY USING THE SAME

CROSS-REFERENCE TO RELATED APPLICATIONS

This application claims priority under 35 U.S.C. §119(a) from Korean Patent Application No. 10-2007-0024674, filed on Mar. 13, 2007, in the Korean Intellectual Property Office, the disclosure of which is incorporated herein in its entirety by reference.

BACKGROUND OF THE INVENTION

1. Field of the Invention

The present general inventive concept relates to a method and apparatus to drive an image display device, and more particularly, to a method and apparatus of compensating for a kick-back voltage to reduce generation of flicker in a liquid crystal display (LCD).

2. Description of the Related Art

A conventional kick-back compensation circuit is disclosed in Korean Patent No. 2006-062645 and Japanese Patent No. 2001-128090.

A liquid crystal display (LCD) displays images by controlling light transmissivity of a liquid crystal element using an electric field. The LCD includes an LCD panel on which liquid crystal cells are arranged in a matrix and a circuit for driving the LCD panel.

Referring to FIG. 1, a gate line GL and a data line DL intersect each other on a lower glass of the LCD panel and a thin film transistor TFT for driving a liquid crystal cell LC is arranged at the intersection of the gate line GL and the data line DL. In addition, a storage capacitor Cst for maintaining the voltage of the liquid crystal cell LC is connected in parallel with the liquid crystal cell LC. The liquid crystal cell LC includes a pixel electrode 11 and a common electrode 12. A capacitor Cgd is connected between the gate line G1 and the liquid crystal cell LC, that is, a gate and a drain of the TFT.

When voltages having the same polarity are continuously applied to liquid crystal cells, displayed images are deteriorated. To prevent this, an AC data voltage having a periodically inverted polarity is used to drive the liquid crystal cells. The polarity of the AC data voltage is inverted for each frame on a basis of a voltage Vcom applied to a common electrode 12.

When the gate voltage of a thin film transistor is logic high, a liquid crystal cell corresponding to the thin film transistor is charged up to the data voltage. However, the voltage charged in the liquid crystal cell is distorted by a kick-back voltage according to a parasitic capacitance of the thin film transistor at the instant of time when the gate voltage of the thin film transistor is transited to logic low, as illustrated in FIG. 2. FIG. 2 illustrates that an RMS (Root Mean Square) value difference between a positive pixel data voltage and a negative pixel data voltage is generated due to the kick-back voltage, which generates flicker. The kick-back voltage varies according to positions in a relatively large display device.

To compensate for the flicker caused by the kick-back voltage, the voltage Vcom applied to the common electrode is controlled using a passive element such as a variable resistor. However, the kick-back voltage varies according to positions in an LCD panel due to RC delay in gate lines, and thus an operation of correcting common voltages for the respective positions using a large number of passive elements is required. Furthermore, it is difficult to accurately control the common voltages with a manual operation.

SUMMARY OF THE INVENTION

The present general inventive concept provides a method and apparatus of compensating for a kick-back voltage, which respectively detect kick-back voltages from sections of an LCD panel and apply the detected kick-back voltages to a pixel data processing operation, and an LCD using the same.

The present general inventive concept also provides a computer-readable recording medium storing a program to execute the method.

Additional aspects and utilities of the present general inventive concept will be set forth in part in the description which follows and, in part, will be obvious from the description, or may be learned by practice of the general inventive concept.

The foregoing and/or other aspects and utilities of the general inventive concept may be achieved by providing a method of compensating for a kick-back voltage, including correcting input pixel data using a kick-back correction function that meets a condition on which a response characteristic of a voltage detected from a pixel electrode of a liquid crystal cell for a positive input pixel signal and a response characteristic of a voltage detected from the pixel electrode of the liquid crystal cell for a negative input pixel signal become symmetrical without causing a saturation state on a basis of a kick-back voltage measured from an LCD panel to generate corrected pixel data; and driving the LCD panel using the corrected pixel data.

The kick-back voltage and the kick-back correction function may be calculated for each of a plurality of sections of the LCD panel. The kick-back voltage and the kick-back correction function may be calculated whenever a controller of the LCD panel is initialized.

The kick-back voltage may be measured through a process including applying a test pixel signal voltage to the LCD panel to drive test liquid crystal cells of each section of the LCD panel, detecting a voltage of pixel electrodes of the test liquid crystal cells of each section of the LCD panel in a period during which the kick-back voltage is generated, and calculating a difference between the test pixel signal voltage and the detected voltage to obtain the kick-back voltage for each section of the LCD panel.

The test pixel signal voltage may be set to a voltage corresponding to a maximum gray scale value, and the period during which the kick-back voltage is generated may follow a period in which the test pixel signal voltage is applied to data lines corresponding to the test liquid crystal cells and a voltage applied to gate lines corresponding to the test liquid crystal cells is transited from logic high to logic low.

The kick-back correction function may be set such that the input pixel data is multiplied by a scale constant having a value between 0 and 1 and then twice the kick-back voltage is added to the multiplication result as an offset value to generate corrected pixel data for pixels to which a positive pixel signal is applied, and the input pixel data is multiplied by the scale constant to generate corrected pixel data for pixels to which a negative pixel signal is applied.

The scale constant may correspond to a value obtained by subtracting twice the kick-back voltage from the maximum gray scale value and dividing the subtraction result by the maximum gray scale value.

The foregoing and/or other aspects and utilities of the general inventive concept may also be achieved by providing a liquid crystal display (LCD) including an LCD panel including a plurality of gate lines and a plurality of data lines arranged in an intersecting manner in a matrix to display an image corresponding to a pixel data voltage applied to the data lines according to a gate pulse signal applied to the gate lines through LCD elements, a controller to generate a gate control signal to select gate lines and a data control signal to output corrected pixel data for each data line, and to correct input pixel data using a kick-back correction function that meets a condition on which a response characteristic of a voltage detected from a pixel electrode of a liquid crystal cell for a positive input pixel signal and a response characteristic of a voltage detected from the pixel electrode of the liquid crystal cell for a negative input pixel signal become symmetrical without causing a saturation state on a basis of a kick-back voltage measured from each of a plurality of sections of the LCD panel to generate corrected pixel data, a gate driver to apply the gate driving pulse to gate lines selected by the gate control signal, and a data driver to generate a voltage corresponding to the corrected pixel data and to apply the voltage to a corresponding data line.

The controller may include a test data generator to generate test pixel data to measure a kick-back voltage, a kick-back parameter calculator to calculate a kick-back voltage for each section of the LCD panel and a scale constant for each section, which are required for the kick-back correction function, using a voltage detected from pixel electrodes of liquid crystal cells of the LCD panel based on the text pixel data, a storage unit to store the kick-back voltage for each section and the scale constant for each section, a kick-back correction unit to apply the kick-back voltage and the scale constant for each section, stored in the storage unit, to the kick-back correction function to obtain corrected pixel data and a second multiplexer to receive the output signal of the kick-back correction unit and the output signal of the test data generator, to select and output the output signal of the test data generator in a kick-back voltage measurement mode, and to select and output the output signal of the kick-back correction unit in other modes.

The kick-back parameter calculator may subtract a digital value corresponding to a voltage measured from pixel electrodes of liquid crystal cells of each section of the LCD panel according to the test pixel data, from the test pixel data to obtain the kick-back voltage for each section.

The kick-back parameter calculator may subtract twice the kick-back voltage for each section from the test pixel data and divide the subtraction result by the test pixel data to obtain the scale constant for each section.

The kick-back correction unit may include a scaler to multiply the input pixel data by a scale constant corresponding to the section including the coordinates of the input pixel data, an offset generator to read a kick-back voltage corresponding to the section including the coordinates of the input pixel data from the storage unit and to multiply the read kick-back voltage by '2' to generate an offset value, a first multiplexer to output the output signal of the offset generator to pixels to which a positive value of the input pixel data is input and to output '0' to pixels to which a negative value of the input pixel data is input; and a summer to sum up the output signal of the scaler and the output signal of the first multiplexer and to output the corrected pixel data.

The foregoing and/or other aspects and utilities of the general inventive concept may also be achieved by providing a computer readable recording medium having embodied thereon a computer program to execute a method of correcting input pixel data using a kick-back correction function that meets a condition on which a response characteristic of a voltage detected from a pixel electrode of a liquid crystal cell for a positive input pixel signal and a response characteristic of a voltage detected from the pixel electrode of the liquid crystal cell for a negative input pixel signal become symmetrical without causing a saturation state on a basis of a kick-back voltage measured from an LCD panel to generate corrected pixel data.

The foregoing and/or other aspects and utilities of the general inventive concept may also be achieved by providing a liquid crystal display (LCD) including an LCD panel having a plurality of sections to display an image, a detector to detect kick-back voltages from one or more of the plurality of sections and a kick-back correction unit to apply the detected kick-back voltages to a kick-back correction function to obtain corrected pixel data.

The foregoing and/or other aspects and utilities of the general inventive concept may also be achieved by providing a method of operating a liquid crystal display (LCD), the method including obtaining kick-back voltages from one or more of a plurality of sections of an LCD panel and applying the obtained kick-back voltages to a kick-back correction function and obtaining corrected pixel data based on the applied obtained voltages to the kick-back correction function.

The foregoing and/or other aspects and utilities of the general inventive concept may also be achieved by providing a liquid crystal display (LCD), including an LCD panel including a plurality of data lines to display an image and a controller to generate a data control signal to output corrected pixel data for one or more of the plurality of data lines, and to correct input pixel data using a kick-back correction function that corresponds to a symmetrical arrangement of a response characteristic of a voltage detected from a pixel electrode of a liquid crystal cell for a positive input pixel signal and a response characteristic of a voltage detected from the pixel electrode of the liquid crystal cell for a negative input pixel signal without causing a saturation state on a basis of a kick-back voltage measured from one or more of a plurality of sections of the LCD panel to generate corrected pixel data.

The foregoing and/or other aspects and utilities of the general inventive concept may also be achieved by providing a liquid crystal display (LCD), including an LCD panel including a first liquid crystal cell disposed in a first position and a second liquid crystal cell disposed in a second position, and a controller to supply a first voltage to the first liquid crystal cell and a second voltage to the second liquid crystal cell according to the first position and the second position.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
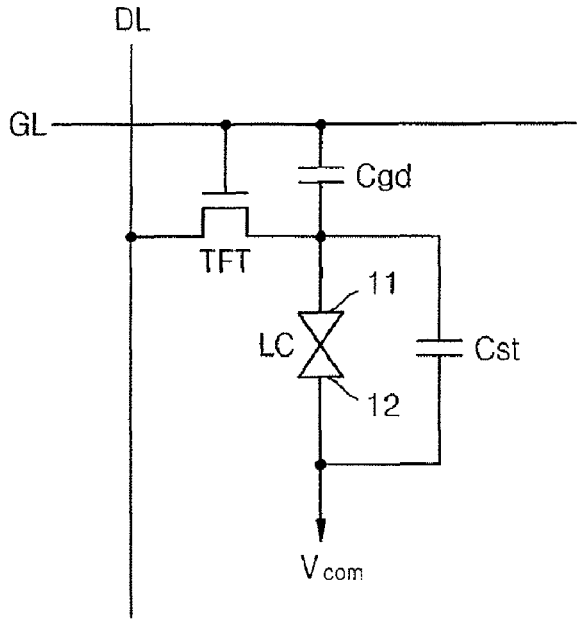
FIG. 1 (PRIOR ART)
FIG. 1 is an equivalent circuit diagram illustrating a unit pixel of a conventional liquid crystal display (LCD) panel.
Figure 2:
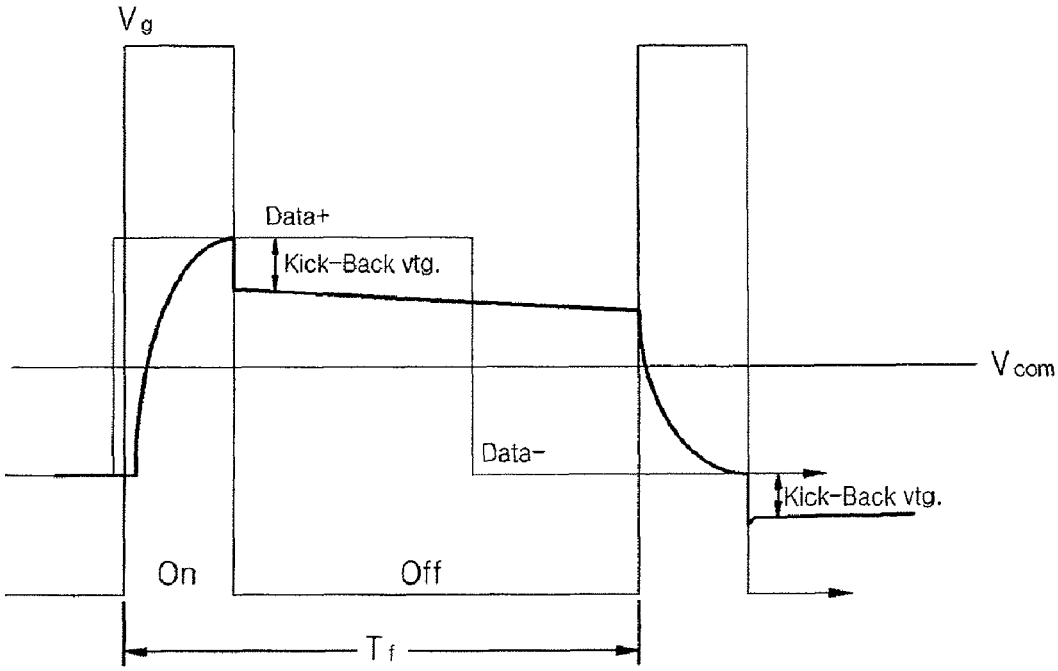
FIG. 2 (PRIOR ART)
FIG. 2 is a waveform diagram illustrating a kick-back voltage generated in an LCD.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

A basic principle of compensation of a kick-back voltage according to the present general inventive concept will now be explained.

The present general inventive concept assumes that a signal applied to an LCD panel is a sinusoidal wave signal in order to model variations in RMS values of positive and negative pixel signals according to a kick-back phenomenon.

That is, assume that a sinusoidal pixel signal applied to an LCD panel is (Mag)sin θ. Then, a magnitude of a voltage detected from a pixel electrode of a liquid crystal cell of the LCD panel after a voltage corresponding to the sinusoidal pixel signal is applied to the LCD panel and the kick-back phenomenon occurs is represented as follows.

$$2k\pi \leqq \theta \leqq (2k+1)\pi; 0 \leqq |\text{Magnitude}| \leqq (Mag) - kb \quad \text{[Expression 1]}$$

$$(2k+1)\pi < \theta < 2(k+1)\pi; kb \leqq |\text{Magnitude}| \leqq (Mag) + kb \quad \text{[Expression 2]}$$

Here, kb represents a kick-back voltage and Mag denotes a maximum magnitude of the sinusoidal signal.

Figure 3A:
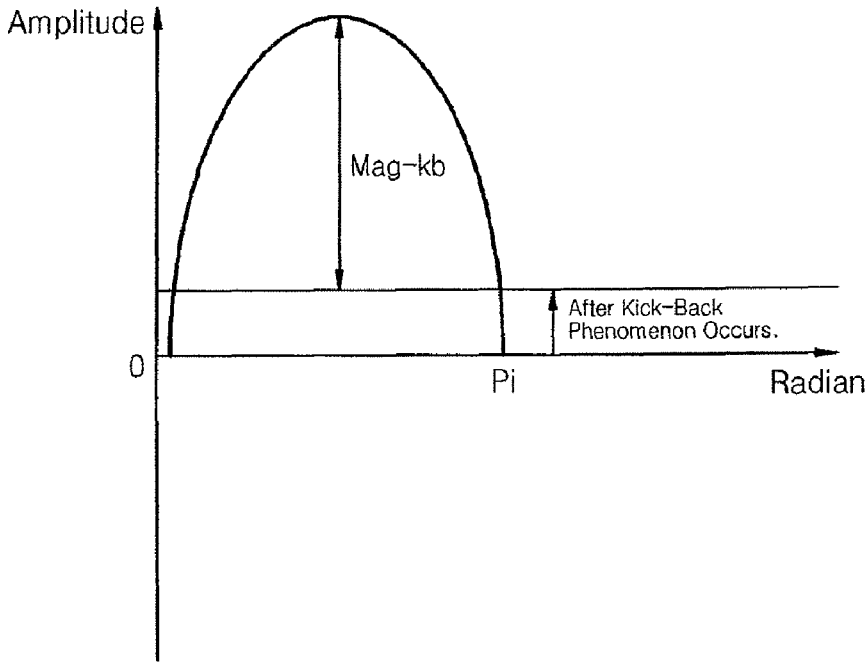
FIGS. 3A and 3B are waveform diagrams illustrating a variation in an amplitude of a voltage detected from a pixel electrode of a liquid crystal cell after a kick-back phenomenon occurs when an LCD panel is driven using a sinusoidal pixel signal according to an embodiment of the present general inventive concept.

Accordingly, when the kick-back phenomenon occurs in a period during which a positive signal voltage is applied, the magnitude of the voltage detected from the pixel electrode of the liquid crystal cell is represented by Expression 1, which is illustrated in FIG. 3A.

Referring to FIG. 3A, X axis is shifted upward due to the kick-back phenomenon. Accordingly, the magnitude of the positive signal voltage is reduced by the kick-back voltage kb. Furthermore, the polarity of the voltage of a signal lower than the kick-back voltage is inverted, and thus the signal has a component opposite to the original signal.

Figure 3B:
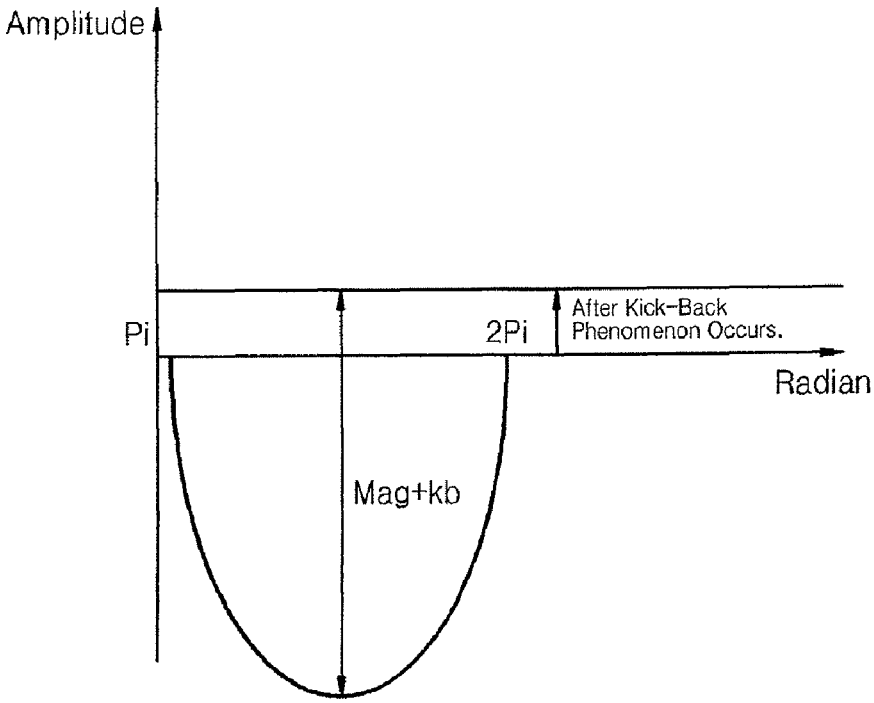

When the kick-back phenomenon occurs in a period during which a negative signal voltage is applied, the magnitude of the voltage detected from the pixel electrode of the liquid crystal cell is represented by Expression 2, which is illustrated in FIG. 3B.

Referring to FIG. 3B, X axis is shifted upward due to the kick-back phenomenon, and thus the magnitude of the negative signal voltage is increased by the kick-back voltage kb. That is, the magnitude corresponding to the kick-back voltage is added to the magnitude of the original signal and a color is represented according to the added signals.

Accordingly, the magnitude of the voltage detected from the pixel electrode of the liquid crystal cell is varied due to the kick-back phenomenon even when a positive signal and a negative signal, which has the same magnitude, are applied to the LCD panel so that color distortion and flicker occur.

That is, a response characteristic of the voltage detected from the pixel electrode of the liquid crystal cell for a positive input pixel signal value and a response characteristic of the voltage detected from the pixel electrode of the liquid crystal cell for a negative input pixel signal value become asymmetrical due to the kick-back phenomenon.

To solve this problem, the present general inventive concept proposes a method of correcting pixel data using a kick-back correction function represented by Expressions 3 and 4.

$$2k\pi \leq \theta \leq (2k+1)\pi; \quad \left\{\left(\frac{Mag - 2kb_{sample}}{Mag}\right)(Mag)\sin\theta + 2kb_{sample}\right\} = \{(Mag - 2kb_{sample})\sin\theta + 2kb_{sample}\} \quad \text{[Expression 3]}$$

$$(2k+1)\pi < \theta < 2(k+1)\pi; \quad \left(\frac{Mag - 2kb_{sample}}{Mag}\right)(Mag)\sin\theta = (Mag - 2kb_{sample})\sin\theta \quad \text{[Expression 4]}$$

Here, $kb_{sample}$ denotes a sampled kick-back voltage, $$\left(\frac{Mag - 2kb_{sample}}{Mag}\right)$$

represents a scale constant, and $(2kb_{sample})$ represents an offset value.

The scale constant is used to prevent saturation that may be generated in a kick-back correction process and the offset value is used to make the response characteristic of the voltage detected from the pixel electrode of the liquid crystal cell for the positive input pixel signal value and the response characteristic of the voltage detected from the pixel electrode of the liquid crystal cell for the negative input pixel signal value become asymmetrical.

Figure 4A:
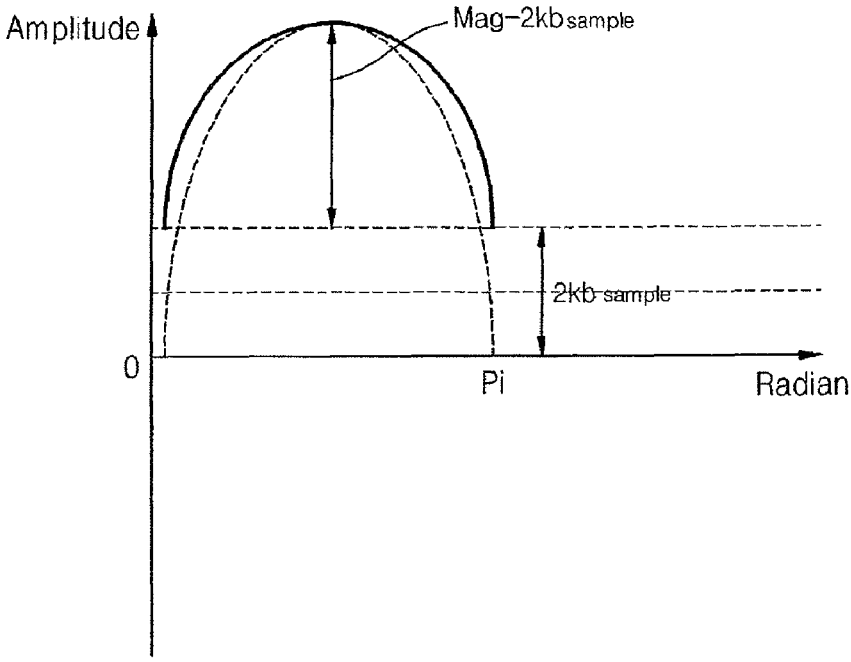
FIGS. 4A and 4B are waveform diagrams illustrating a pixel processing method to compensate for a kick-back voltage according to an embodiment of the present general inventive concept.
Figure 4B:
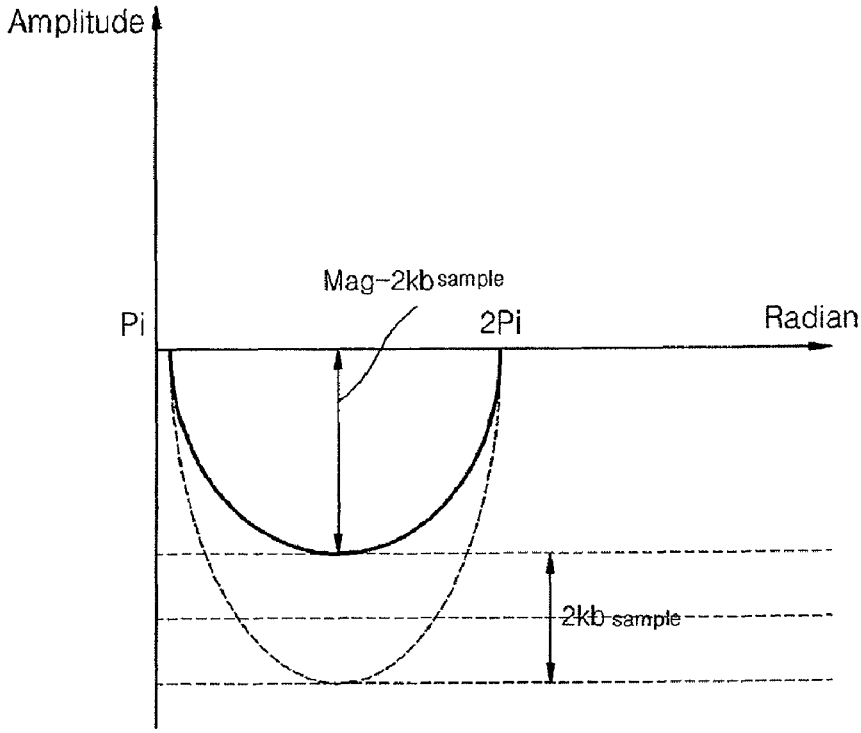

FIG. 4A illustrates a pixel processing method for a positive signal and FIG. 4B illustrates a pixel processing method for a negative signal. In FIGS. 4A and 4B, dotted lines represent magnitudes of the pixel signals before the kick-back correction process is carried out and solid lines represent the magnitudes of the pixel signals after the kick-back correction process is performed.

Referring to FIGS. 4A and 4B, the positive signal is corrected in such a manner that the original signal is multiplied by the scale constant to scale the original signal and then twice the kick-back voltage is added to the scaling result as an offset value, as represented by Expression 3. The negative signal is corrected in such a manner that the original signal is multiplied by the scale constant to scale the original signal and the offset value is not added to the scaling result, as represented by Expression 4.

FIG. 4A illustrates that the maximum value of the positive pixel signal before/after the correction process corresponds to Mag. If the scaling process is not performed, the maximum value of the corrected pixel signal becomes (Mag+2kb$_{sample}$) so that it exceeds the maximum allowance value Mag of the pixel signal to result in a saturation state. That is, where the positive pixel signal has a value between (Mag−2kb$_{sample}$) and (Mag), the saturation state is generated when the positive pixel signal is corrected using the offset value without being scaled.

For example, the scale constant is determined by dividing a result obtained by subtracting twice the sampled kick-back voltage kb$_{sample}$ from the maximum gray scale value Mag by the maximum gray scale value Mag, when the maximum gray scale value Mag is applied to the LCD panel.

Figure 5A:
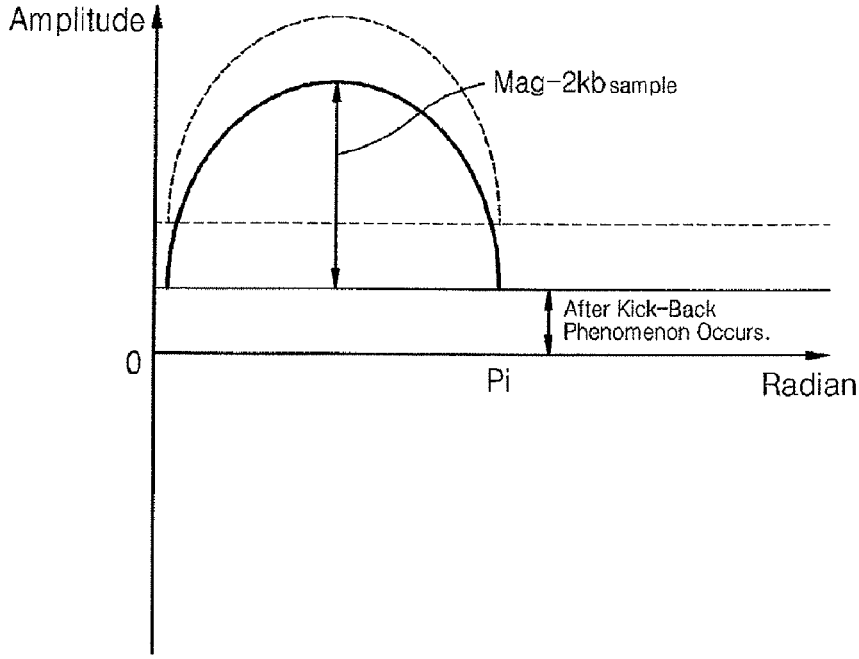
FIGS. 5A and 5B are waveform diagrams illustrating an amplitude of a voltage detected from a pixel electrode of a liquid crystal cell after a kick-back phenomenon occurs when an LCD panel is driven using kick-back voltage compensated pixel data according to an embodiment of the present general inventive concept.
Figure 5B:
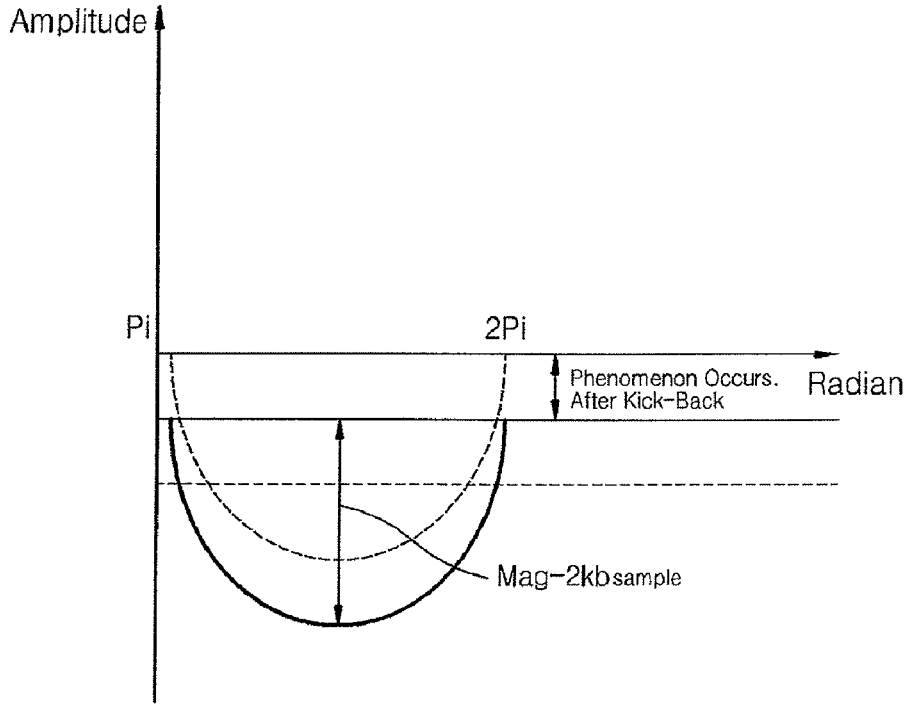

If the kick-back phenomenon occurs when the pixel signal is corrected using the kick-back correction function represented by Expressions 3 and 4 and the LCD panel is driven with the corrected pixel signal, the voltage detected from the pixel electrode of the liquid crystal cell has a magnitude as illustrated in FIGS. 5A and 5B.

Figure 6:
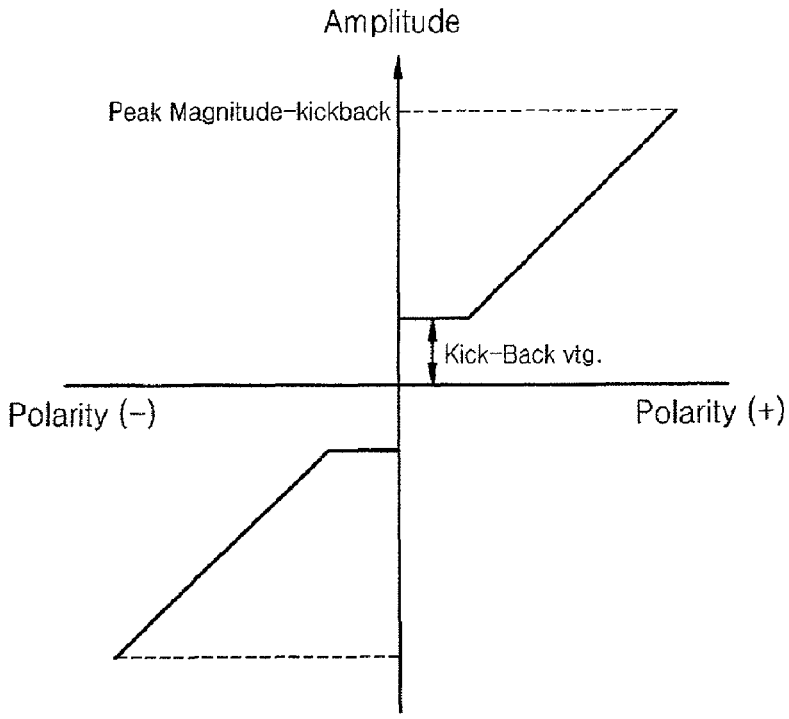
FIG. 6 illustrates a response characteristic of an LCD for positive and negative pixel signals after a kick-back phenomenon occurs when an LCD panel is driven using kick-back voltage compensated pixel data according to an embodiment of the present general inventive concept.

Magnitude variation characteristic of the positive pixel signal illustrated in FIG. 5A and magnitude variation characteristic of the negative pixel signal illustrated in FIG. 5B are symmetrical. That is, when the corrected pixel signal is applied to the LCD panel and the kick-back phenomenon occurs, the response characteristics of the positive and negative pixel signals become identical to each other, as illustrated in FIG. 6.

Figure 8:
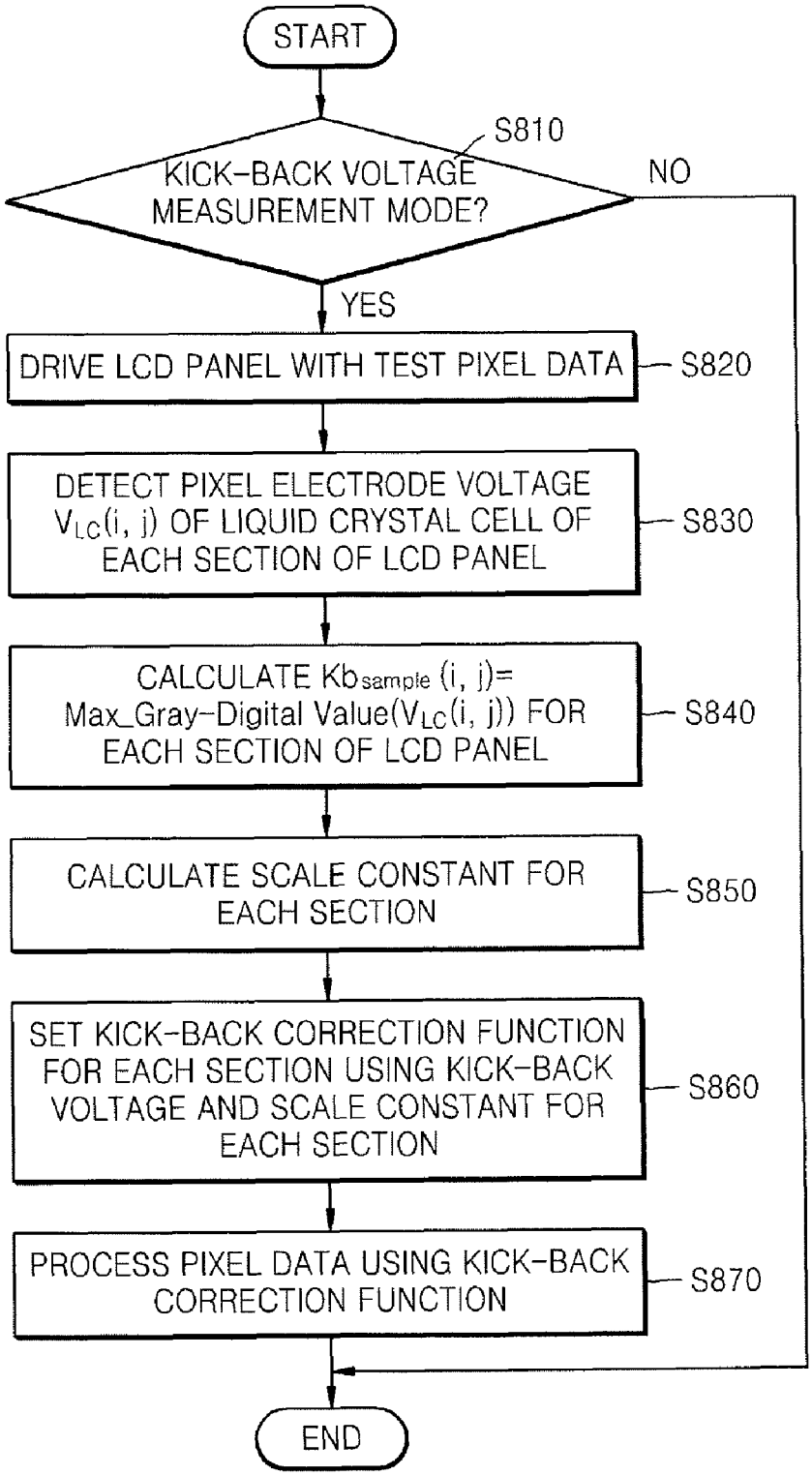
FIG. 8 is a flow chart of a kick-back voltage compensating method according to an embodiment of the present general inventive concept.

A method of compensating for a kick-back voltage based on the aforementioned kick-back correction principle according to an embodiment of the present general inventive concept will now be explained with reference to FIG. 8.

It is determined whether an LCD panel driving system is converted to a kick-back voltage measurement mode in operation S810. For example, the kick-back voltage measurement mode can be executed whenever the LCD panel driving system is initialized. Specifically, the kick-back voltage measurement mode can be carried out whenever an LCD panel controller is initialized.

When the LCD panel driving system is converted to the kick-back mode measurement mode, test pixel data is applied to an LCD panel driver to drive an LCD panel in operation S820. The test pixel data can be a gray signal having a maximum scale value. Pixel data having other scale values can be used as the test pixel data.

Figure 7:
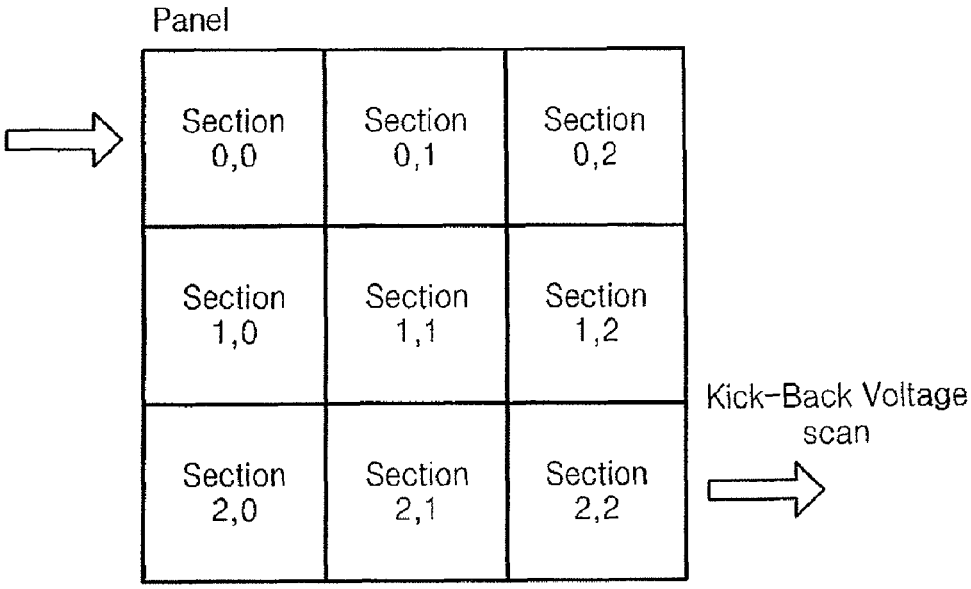
FIG. 7 illustrates a division of an LCD panel into multiple sections according to an embodiment of the present general inventive concept.

After the test pixel data is applied and a kick-back phenomenon occurs, a pixel electrode voltage $V_{LC}$ of a test liquid crystal cell included in each of sections of the LCD panel is sampled and detected in operation S830. For example, the LCD panel can be divided into multiple sections, as illustrated in FIG. 7, and the number of divided sections depends on the size of the LCD panel. This is for the purpose of accurately correcting the kick-back voltage because the kick-back voltage becomes different according to positions in the LCD panel.

Then, a kick-back voltage kb$_{sample}$(i,j) for each of the sections of the LCD panel is obtained through Expression 5 using the pixel electrode voltage $V_{LC}$ in operation S840.

$$kb_{sample}(i,j)=\text{Max_Gray}-\text{Digital value}\{V_{LC}(i,j)\} \quad \text{[Expression 5]}$$

Here, kb$_{sample}$(i,j) represents a kick-back voltage sampled in a section (i, j) illustrated in FIG. 7, and Digital value{$V_{LC}$(i, j)} denotes a digital value of the sampled voltage of the pixel electrode of the test liquid crystal cell of the section (i, j) after the kick-back phenomenon occurs when the test pixel data is determined as the gray signal Max_Gray having the maximum scale value and applied to the LCD panel.

After the kick-back voltage kb$_{sample}$(i,j) for each section of the LCD panel is obtained, a scale constant C(i, j) for each section of the LCD panel calculated through Expression 6 using the kick-back voltage kb$_{sample}$(i,j) for each section of the LCD panel in operation S850.

$$O(i,\ j)=\frac{\text{Max_Gray}-2k_{sample}}{\text{Max_Gray}} \quad \text{[Expression 6]}$$

A kick-back correction function to generate kick-back corrected pixel data d(x,y)_positive_com from pixel data d(x,y)_positive in coordinates (x, y) is set as represented by Expression 7 for pixels to which a positive pixel signal is applied using the kick-back voltage kb$_{sample}$(i,j) and the scale constant C(i, j). A kick-back correction function to generate kick-back corrected pixel data d(x,y)_negative_com from pixel data d(x,y)_negative in coordinates (x, y) is set as represented by Expression 8 for pixels to which a negative pixel signal is applied using the kick-back voltage kb$_{sample}$(i,j) and the scale constant C(i, j) in operation S860.

$$d(x,y)_\text{positive_com}=C(i,j)\cdot d(x,y)_\text{positive}+2kb_{sample}(i,\ j) \quad \text{[Expression 7]}$$

$$d(x,y)_\text{negative_com}=C(i,j)\cdot d(x,y)_\text{negative} \quad \text{[Expression 8]}$$

Input pixel data is kick-back-corrected using the kick-back correction functions as represented by Expressions 7 and 8, which are set in operation S860, and the LCD panel is driven with the kick-back-corrected pixel data in operation S870.

An LCD to which the aforementioned kick-back correction principle according to an embodiment of the present general inventive concept will now be explained.

Figure 9:
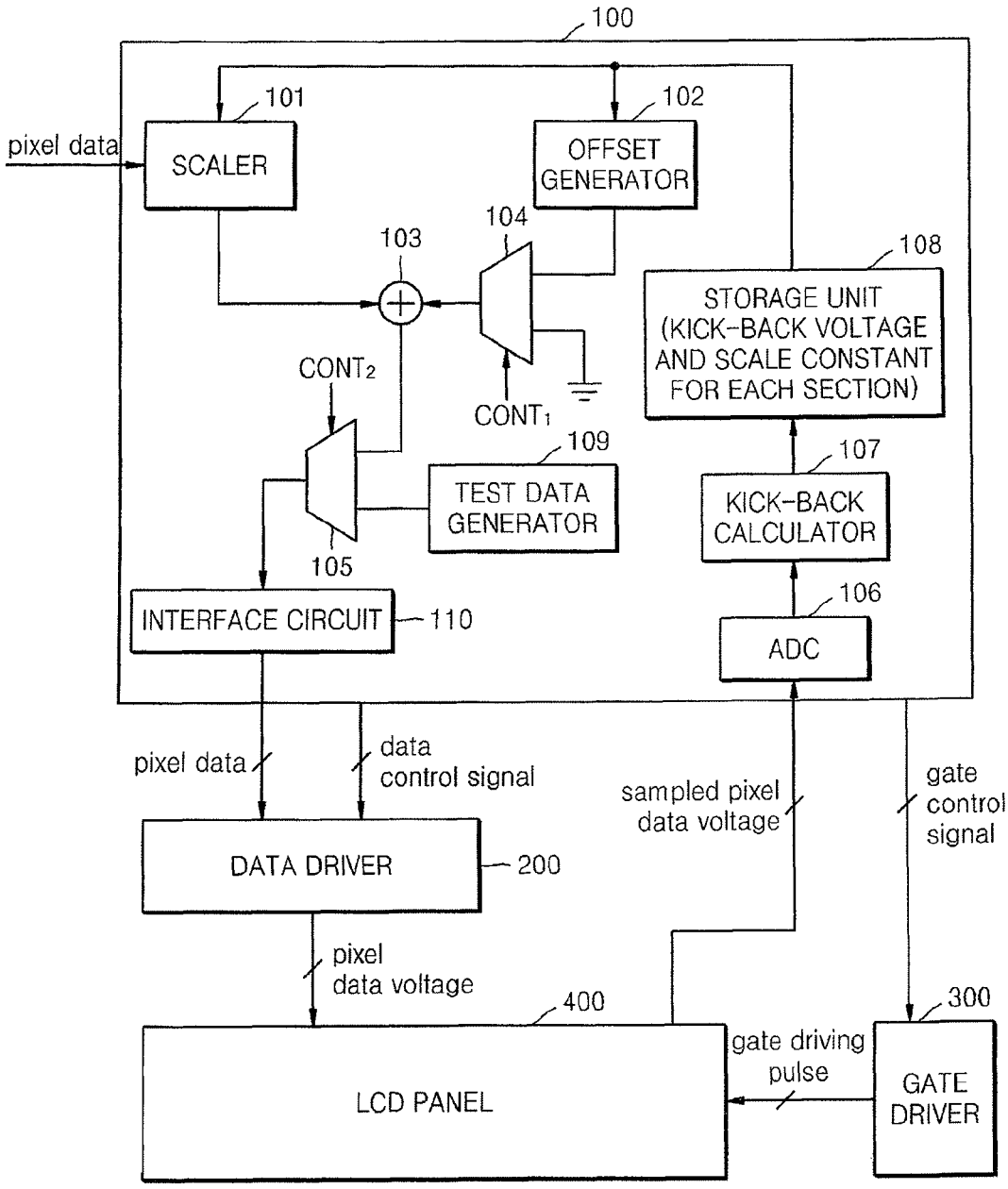
FIG. 9 is a block diagram of an LCD according to an embodiment of the present general inventive concept.

FIG. 9 is a block diagram of the LCD according to an embodiment of the present general inventive concept. Referring to FIG. 9, the LCD includes a controller 100, a data driver 200, a gate driver 300, and an LCD panel 400.

The controller 100 includes a scaler 101, an offset generator 102, a summer 103, first and second multiplexers 104 and 105, an analog-to-digital converter 106, a kick-back calculator 107, a storage unit 108, a test data generator 109, and an interface circuit 110.

The LCD panel 400 includes a plurality of LCD elements LC each having a unit pixel as illustrated in FIG. 1. The plurality of LCD elements are connected to a plurality of gate lines and a plurality of data lines in a matrix form. A pixel data voltage applied to the data lines is transferred to a pixel electrode of each LCD element LC whenever a driving pulse signal is applied to the gate lines and an image is represented according to a voltage difference between the pixel electrode and a common electrode of the LCD element LC.

The gate driver 300 is connected to the gate lines of the LCD panel 400, generates a gate driving pulse signal composed of a gate on voltage and a gate off voltage in response to a gate control signal input from the controller 100 and applies the gate driving pulse signal to the gate lines.

The data driver 200 is connected to the data lines of the LCD panel 400, generates a voltage corresponding to pixel data input from the controller 100 and applies the voltage to corresponding data lines.

A data processing operation to execute kick-back correction, carried out by the controller 100 will now be explained in detail.

The test data generator 109 generates test pixel data required to measure a kick-back voltage. The test pixel data can be gray data Max_Gray having a maximum scale value.

The second multiplexer 105 receives the output signal of the summer 103 and the output signal of the test data generator 109 and selects one of the received signals in response to a second control signal CONT2. The second control signal CONT2 selects the output signal of the test data generator 109 in the kick-back voltage measurement mode and selects the output signal of the summer 103 in other modes. In the present embodiment, the kick-back voltage measurement mode is executed whenever the LCD panel driving system is initialized.

The test pixel data is applied to the data driver 200 through the interface circuit 110 in the kick-back mode measurement mode. Then, the data driver 200 applies a voltage corresponding to the test pixel data to all the data lines of the LCD panel 400.

Accordingly, the test pixel data is transferred to the pixel electrodes of the LCD elements connected to a gate line to which the gate driving pulse signal having the gate on voltage to represent an image.

When the test pixel data is applied to data lines corresponding to the test liquid crystal cells of each of the sections as illustrated in FIG. 7 in the kick-back voltage measurement mode, as described above, and the gate driving pulse signal is transited from logic high to logic low, a kick-back phenomenon occurs. The analog-to-digital converter 106 samples the voltage of the pixel electrodes of the LCD elements of the corresponding liquid crystal cells in a period during which the kick-back phenomenon occurs and converts the sampled voltage into digital data.

The kick-back calculator 107 calculates the kick-back voltage $kb_{sample}(i,j)$ for each section of the LCD panel using the digital data through Expression 5 and calculates the scale constant C(i, j) for each section of the LCD panel using Expression 6.

The kick-back voltage $kb_{sample}(i,j)$ and the scale constant C(i, j) for each section of the LCD panel, calculated by the kick-back calculator 107, are stored in the storage unit 108. The storage unit 108 can be composed of registers.

When pixel data is input to the controller 100 after the kick-back voltage measurement mode is finished, the pixel data is processed as follows in order to correct the kick-back voltage.

The controller 100 reads a scale constant corresponding to a section including the coordinates of the input pixel data from the storage unit 108 and transfers the read scale constant to the scaler 101. In addition, the controller 100 reads the kick-back voltage corresponding to the section including the coordinates of the input pixel data from the storage unit 108 and transfers the read kick-back voltage to the offset generator 102.

The scaler 101 multiplies the input pixel data by the scale constant and outputs the multiplication result to the summer 103. The offset generator 102 multiplies the kick-back voltage by '2' to generate an offset value and outputs the offset value to a first input terminal of the first multiplexer 104. The first multiplexer 104 has the first input terminal connected to an output terminal of the offset generator 102 and a second input terminal grounded.

The first multiplexer 104 selects the first input terminal and outputs the signal input through the first input terminal to pixels to which a positive pixel signal is applied and selects the second input terminal and outputs the signal input through the second input terminal to pixels to which a negative pixel signal is applied in response to a first control signal CONT1. Accordingly, the first multiplexer 104 outputs the offset value only to the pixels to which the positive pixel signal is applied and outputs '0' to the pixels to which the negative pixel signal is applied.

The summer 103 sums up the output signal of the scaler 101 and the output signal of the first multiplexer 104 and outputs the summed signal to the second multiplexer 105. The output signal of the summer 103 corresponds to the kick-back corrected pixel data obtained by processing the input pixel data using the kick-back correction functions represented by Expressions 7 and 8.

The second multiplexer 105 receives the output signal of the summer 103 and the output signal of the test data generator 109 and selects the signal input from the summer 103 in response to the second control signal CONT2 in a pixel data processing mode. Accordingly, the kick-back corrected pixel data is output to the data driver 200 through the interface circuit 110 in the pixel data processing mode, and thus the LCD panel is driven with the kick-back corrected pixel data.

In this manner, the kick-back voltage can be automatically corrected in the pixel data processing operation without correcting a common voltage using a passive element.

As described above, the present general inventive concept can detect a kick-back voltage for each of sections of an LCD panel and apply the detected kick-back voltage to a pixel data processing operation, and thus a process of controlling a common voltage using passive elements can be omitted. Furthermore, the kick-back voltage can be automatically corrected with accuracy to improve flicker.

The present general inventive concept can be implemented as a method, an apparatus, and a system. When the present general inventive concept is implemented in software, its component elements are code segments that execute necessary operations. The computer-readable medium can include a computer-readable recording medium and a computer-readable transmission medium. The computer-readable recording medium is any data storage device that can store data that can be thereafter read by a computer system. Examples of the computer-readable medium include electronic circuits, semiconductor memory devices, read-only memory (ROM), CD-ROMs, random access memory (RAM), flash memories, erasable ROMs (EROMs), floppy disks, optical data storage devices, hard disks, optical fibers, radio frequency (RF) networks, magnetic tapes, etc. The computer-readable transmission medium can transmit carrier waves or signals (e.g., wired or wireless data transmission through the Internet. Also, functional programs, codes, and code segments to accomplish the present general inventive concept can be easily construed by programmers skilled in the art to which the present general inventive concept pertains.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A method of compensating for a kick-back voltage, the method comprising:

correcting input pixel data using a kick-back correction function that meets a condition on which a response characteristic of a voltage detected from a pixel electrode of a liquid crystal cell for a positive input pixel signal and a response characteristic of a voltage detected from the pixel electrode of the liquid crystal cell for a negative input pixel signal become symmetrical without causing a saturation state on a basis of a kick-back voltage measured from an LCD panel to generate corrected pixel data; and driving the LCD panel using the corrected pixel data, wherein the kick-back correction function is set such that the input pixel data is multiplied by a scale constant having a value between 0 and 1 and then twice the kick-back voltage is added to the multiplication result as an offset value to generate corrected pixel data for pixels to which a positive pixel signal is applied, and the input pixel data is multiplied by the scale constant to generate corrected pixel data for pixels to which a negative pixel signal is applied.

2. The method of claim 1, wherein the kick-back voltage and the kick-back correction function are calculated for each of a plurality of sections of the LCD panel.

3. The method of claim 1, wherein the kick-back voltage is measured for each of the plurality of sections of the LCD panel whenever a controller of the LCD panel is initialized, and the kick-back correction function is set based on the measured kick-back voltage.

4. The method of claim 1, wherein the kick-back voltage is measured through a process comprising:

applying a test pixel signal voltage to the LCD panel to drive test liquid crystal cells of each section of the LCD panel;

detecting a voltage of pixel electrodes of the test liquid crystal cells of each section of the LCD panel in a period during which the kick-back voltage is generated; and calculating a difference between the test pixel signal voltage and the detected voltage to obtain the kick-back voltage for each section of the LCD panel.

5. The method of claim 4, wherein the test pixel signal voltage is set to a voltage corresponding to a maximum gray scale value.

6. The method of claim 4, wherein the period during which the kick-back voltage is generated follows a period in which the test pixel signal voltage is applied to data lines corresponding to the test liquid crystal cells and a voltage applied to gate lines corresponding to the test liquid crystal cells is transited from logic high to logic low.

7. The method of claim 1, wherein the scale constant corresponds to a value obtained by subtracting twice the kick-back voltage from the maximum gray scale value and dividing the subtraction result by the maximum gray scale value.

8. A non-transitory computer-readable recording medium having embodied thereon a computer program to execute a method, wherein the method comprises:

correcting input pixel data using a kick-back correction function that meets a condition on which a response characteristic of a voltage detected from a pixel electrode of a liquid crystal cell for a positive input pixel signal and a response characteristic of a voltage detected from the pixel electrode of the liquid crystal cell for a negative input pixel signal become symmetrical without causing a saturation state on a basis of a kick-back voltage measured from an LCD panel to generate corrected pixel data; and driving the LCD panel using the corrected pixel data, wherein the kick-back correction function is set such that the input pixel data is multiplied by a scale constant having a value between 0 and 1 and then twice the kick-back voltage is added to the multiplication result as an offset value to generate corrected pixel data for pixels to which a positive pixel signal is applied, and the input pixel data is multiplied by the scale constant to generate corrected pixel data for pixels to which a negative pixel signal is applied.

9. A liquid crystal display (LCD), comprising:

an LCD panel including a plurality of gate lines and a plurality of data lines arranged in an intersecting manner in a matrix to display an image corresponding to a pixel data voltage applied to the data lines according to a gate pulse signal applied to the gate lines through LCD elements;

a controller to generate a gate control signal to select gate lines and a data control signal to output corrected pixel data for each data line, and to correct input pixel data using a kick-back correction function that meets a condition on which a response characteristic of a voltage detected from a pixel electrode of a liquid crystal cell for a positive input pixel signal and a response characteristic of a voltage detected from the pixel electrode of the liquid crystal cell for a negative input pixel signal become symmetrical without causing a saturation state on a basis of a kick-back voltage measured from each of a plurality of sections of the LCD panel to generate corrected pixel data; and a gate driver to apply the gate driving pulse to gate lines selected by the gate control signal; and a data driver to generate a voltage corresponding to the corrected pixel data and applying the voltage to a corresponding data line, wherein the kick-back correction function is set such that the input pixel data is multiplied by a scale constant having a value between 0 and 1 and then twice the kick-back voltage is added to the multiplication result as an offset value to generate corrected pixel data for pixels to which a positive pixel signal is applied, and the input pixel data is multiplied by the scale constant to generate corrected pixel data for pixels to which a negative pixel signal is applied.

10. The LCD of claim 9, wherein the kick-back correction function is determined on the basis of a kick-back voltage measured whenever the controller is initialized.

11. The LCD of claim 9, wherein the controller comprises:

a test data generator to generate test pixel data to measure a kick-back voltage;

a kick-back parameter calculator to calculate a kick-back voltage for each section of the LCD panel and a scale constant for each section, which are required for the kick-back correction function, using a voltage detected from pixel electrodes of liquid crystal cells of the LCD panel based on the text pixel data;

a storage unit to store the kick-back voltage for each section and the scale constant for each section;

a kick-back correction unit to apply the kick-back voltage and the scale constant for each section, stored in the storage unit, to the kick-back correction function to obtain corrected pixel data; and a first multiplexer to receive the output signal of the kick-back correction unit and the output signal of the test data generator, to select and output the output signal of the test data generator in a kick-back voltage measurement mode, and to select and output the output signal of the kick-back correction unit in other modes.

12. The LCD of claim 11, wherein the kick-back parameter calculator subtracts a digital value corresponding to a voltage, which measured from pixel electrodes of liquid crystal cells of each section of the LCD panel according to the test pixel data, from the test pixel data to obtain the kick-back voltage for each section.

13. The LCD of claim 11, wherein the kick-back parameter calculator subtracts twice the kick-back voltage for each section from the test pixel data and divides the subtraction result by the test pixel data to obtain the scale constant for each section.

14. The LCD of claim 11, wherein the test pixel data includes pixel data having a maximum gray scale value.

15. The LCD of claim 11, wherein the kick-back voltage measurement mode is executed whenever the controller is initialized.

16. The LCD of claim 11, wherein the kick-back correction unit comprises:

a scaler to multiply the input pixel data by a scale constant corresponding to the section including the coordinates of the input pixel data;

an offset generator to read a kick-back voltage corresponding to the section including the coordinates of the input pixel data from the storage unit and to multiply the read kick-back voltage by '2' to generate an offset value;

a second multiplexer to output the output signal of the offset generator to pixels to which a positive value of the input pixel data is input and to output '0' to pixels to which a negative value of the input pixel data is input; and a summer to sum up the output signal of the scaler and the output signal of the second multiplexer and to output the corrected pixel data.

17. A liquid crystal display (LCD), comprising:

an LCD panel having a plurality of sections to display an image;

a detector to detect kick-back voltages from one or more of the plurality of sections; and a kick-back correction unit to apply the detected kick-back voltages to a kick-back correction function to obtain corrected pixel data, wherein the kick-back correction function is set such that input pixel data of the image to be displayed is multiplied by a scale constant having a value between 0 and 1 and then twice the kick-back voltage is added to the multiplication result as an offset value to generate corrected pixel data for pixels to which a positive pixel signal is applied, and the input pixel data is multiplied by the scale constant to generate corrected pixel data for pixels to which a negative pixel signal is applied.

18. A method of operating a liquid crystal display (LCD), the method comprising:

obtaining kick-back voltages from one or more of a plurality of sections of an LCD panel; and applying the obtained kick-back voltages to a kick-back correction function; and obtaining corrected pixel data based on the applied obtained voltages to the kick-back correction function, wherein the kick-back correction function is set such that input pixel data of the image to be displayed is multiplied by a scale constant having a value between 0 and 1 and then twice the kick-back voltage is added to the multiplication result as an offset value to generate corrected pixel data for pixels to which a positive pixel signal is applied, and the input pixel data is multiplied by the scale constant to generate corrected pixel data for pixels to which a negative pixel signal is applied.

19. A liquid crystal display (LCD), comprising:

an LCD panel including a plurality of data lines to display an image corresponding to pixel data; and a controller to generate pixel data corrected with regard to input pixel data using a kick-back correction function established on a basis of a kick-back voltage measured from one or more of a plurality of sections of the LCD panel, wherein the kick-back correction function is set such that input pixel data of the image to be displayed is multiplied by a scale constant having a value between 0 and 1 and then twice the kick-back voltage is added to the multiplication result as an offset value to generate corrected pixel data for pixels to which a positive pixel signal is applied, and the input pixel data is multiplied by the scale constant to generate corrected pixel data for pixels to which a negative pixel signal is applied.

20. The LCD of claim 19, wherein the kick-back correction function corresponds to a symmetrical arrangement of a response characteristic of a voltage detected from a pixel electrode of a liquid crystal cell for a positive input pixel signal and a response characteristic of a voltage detected from the pixel electrode of the liquid crystal cell for a negative input pixel signal without causing a saturation state on a basis of the kick-back voltage measured from one or more of the plurality of sections of the LCD panel.

21. The LCD of claim 19, further comprising:

a gate driver to generate a gate driving pulse to be applied to one or more of a plurality of gate lines of the LCD; and a data driver to generate a voltage corresponding to the corrected pixel data and apply the voltage to the plurality of data lines of the LCD.

* * * * *